US005369386A

United States Patent [19]

Alden et al.

[11] Patent Number: 5,369,386

[45] Date of Patent: Nov. 29, 1994

[54] REMOVABLE MAGNETIC ZERO/SPAN ACTUATOR FOR A TRANSMITTER

[75] Inventors: Jerome S. Alden, Aurora; Victor J. Budan, Eastlake; Harold W. Thompson, N. Madison, all of Ohio

[73] Assignee: Elsag International B.V., Amsterdam, Netherlands

[21] Appl. No.: 975,637

[22] Filed: Nov. 13, 1992

[51] Int. Cl.[5] ..... H01H 9/00

[52] U.S. Cl. ..... 335/206; 335/207

[58] Field of Search ..... 337/206, 205, 207

[56] References Cited

U.S. PATENT DOCUMENTS

| | | | |
|---|---|---|---|
| 3,469,042 | 9/1969 | Sandor | 200/16 C |
| 3,527,903 | 9/1970 | Holland et al. | 335/206 |
| 4,737,751 | 4/1988 | Risk | 335/207 |
| 4,783,659 | 11/1988 | Frick . | |
| 4,965,417 | 10/1990 | Massie | 335/207 |
| 4,975,547 | 12/1990 | Nakayama et al. | 200/16 |

FOREIGN PATENT DOCUMENTS

| | | |
|---|---|---|
| 7419684 | 9/1974 | Germany . |
| 2758856 | 7/1979 | Germany . |
| 2804952 | 8/1979 | Germany . |
| 3345822 | 6/1985 | Germany . |
| PCT/US880-3280 | 5/1989 | WIPO . |

*Primary Examiner*—Lincoln Donovan

*Attorney, Agent, or Firm*—Michael M. Rickin; Paul R. Katterle

[57] ABSTRACT

A magnetic actuator for adjusting the zero and span settings of a transmitter used in industrial process control systems. The actuator has a single magnet in a housing. The actuator is removable from the transmitter.

When the actuator is unactuated the magnet is in a null position wherein it does not actuate either the zero or span setting reed switches. The magnet can be moved to either a first position wherein it actuates the zero setting reed switch or a second position wherein it actuates the span setting reed switch. The actuator applies a torque in the proper direction to return the magnet to the null position when the torque applied to move the magnet to either the first or second position is removed.

20 Claims, 7 Drawing Sheets

REMOVABLE MAGNETIC ZERO/SPAN ACTUATOR FOR A TRANSMITTER

BACKGROUND OF THE INVENTION

1. Field of the Invention

The present invention relates to transmitters used in industrial process control systems and more particularly to the magnetic actuation of the zero and span adjustments of such transmitters.

2. Description of the Prior Art

Two-wire transmitters (as well as three-wire and four-wire transmitters) find widespread use in industrial process control systems, A two-wire transmitter includes a pair of terminals which are connected in a current loop together with a power source and a load, The two-wire transmitter is powered by the loop current flowing through the current loop, and varies the magnitude of the loop current as a function of a parameter or condition which is sensed, Three and four wire transmitters have separate leads for supply current and outputs, In general, the transmitters comprise energized electrical circuits which are enclosed in a sealed housing such that ignition of any combustible atmosphere by faults or sparks from the energized circuit is contained in the housing.

Although a variety of operating ranges are possible, the most widely used two-wire transmitter output varies from 4 to 20 milliamperes as a function of the sensed parameter, It is typical with a two-wire transmitter to provide adjustment of the transmitter so that a minimum or zero value of the parameter sensed corresponds to the minimum output (for example a loop current of 4 milliamperes) and that- the maximum parameter value to be sensed corresponds to the maximum output (for example 20 milliamperes).

The minimum and maximum parameter values will vary from one industrial process installation to another. It is desirable, therefore, to provide some means for setting the maximum and minimum output levels in the field, and this is done typically with electrically energized zero and span potentiometers sealed in the housing. With some transmitters, a housing cover must be removed to gain access to the potentiometers for adjustment, undesirably exposing the atmosphere surrounding the transmitter to the live circuits in the transmitter.

A variety of techniques are available for adjusting the potentiometers while sealing potentially explosive atmospheres surrounding the transmitter from the electrically live circuits in the transmitter. In some transmitters, a rotary adjustment shaft for adjusting a potentiometer is closely fitted through a bore in the housing to provide a long flame path for quenching ignition in the housing before it reaches the atmosphere surrounding the housing. In yet another arrangement, the potentiometers are mechanically coupled to a relatively large bar magnet which is then rotated magnetically by another bar magnet outside the live circuit's enclosure. This arrangement with bar magnets can have the disadvantage of mechanical hysteresis, making precise span and zero setting difficult. Actuated switches are also used for setting span and zero in transmitters, such switches requiring an opening through the wall of the transmitter's housing to provide for mechanical coupling to the switch.

For many process control environments, the transmitter itself is required to have an explosion-proof enclosure. This means that, if a spark takes place inside of the transmitter housing which ignites gases within the housing, no hot gases should be propagated from the interior of the transmitter to the exterior which could cause any surrounding combustible atmosphere to ignite.

Providing for zero and span adjustments which are accessible from outside the transmitter (so that the housing would not have to be opened) is desirable, but makes it difficult (or expensive) to maintain the explosion-proof characteristics of the transmitter. One arrangement for adjusting the zero and span of a transmitter from outside of the housing is suggested in U.S. Pat. No. 4,783,659 ("the '659 Patent") which issued on Nov. 8, 1988. The transmitter described in the '659 Patent includes a communications circuit which can take a variety of forms including, as is shown in FIG. 1 of the '659 Patent, magnetically actuated reed switches which are activated with a magnet from outside of the transmitter. The '659 Patent does not further show or describe the magnet or any structure for using the same to activate the reed switches.

In addition to the actuator disclosed in the '659 Patent, other external span and zero actuators have, in the past, needed either bulky magnet pairs for transmitting rotational force or passages formed through the transmitter housing wall, so that one end of the actuating mechanism extends into the chamber which contains the transmitter electronics, while the other end is accessible from the exterior of the transmitter. In order to maintain explosion-proof characteristics, very long flame paths must be created with very tight tolerances. It is also important that the passages be sealed so that moisture cannot enter the transmitter housing through the span and zero actuator passages.

As can be appreciated from the above, it would be desirable in providing for zero and span adjustments which are accessible from outside of the transmitter housing to eliminate the need for a long flame path and very tight tolerances. A transmitter which has externally accessible zero and span adjustments without the need for a long flame path and very tight tolerances is described in International Application Number PCT/US88/03280 which was published on May 5, 1989 as International Publication Number WO89/04014 ("the 03280 PCT application").

The transmitter described in the 03280 PCT application has zero and span magnetically actuated reed switches located in an interior chamber of the housing adjacent the housing's center wall. A relatively flat surface on the exterior of the transmitter housing has a recess formed therein. A pair of internally threaded blind holes extend downward from the recess into the center wall of the housing. A movable permanent magnet is situated in each blind hole. Each magnet is press fit into a lower recess of an associated screw which extend down into the associated blind hole. A spring is coaxially mounted on each magnet. A rubber washer is positioned below the head of each screw to provide an environmental seal for the blind hole. Access to the screws from the exterior of the housing is provided by a plate which is removably attached to the flat surface by a pair of screws.

Adjustment of the zero and span settings for the transmitter described in the 03280 PCT application is accomplished by first removing the plate with a screwdriver to thereby allow a technician to have access to the upper ends of the screws associated with the zero and span movable magnets. The technician can then reset the zero and span settings of the transmitter by using a screwdriver to loosen the screws. The spring associated with the screw is under compression and the loosening of the screw allows the spring to push the screw up so that the centerline of the magnet is aligned with the centerline of the associated reed switch. The electronics to which the reed switches are connected then adjusts the zero or span settings of the transmitter. After adjusting the zero and span settings of the transmitter the technician should tighten the screw to recompress the spring and move the centerline of the magnet out of alignment with the centerline of the reed switch. In addition, the technician should reattach the plate to the flat surface.

While the transmitter described in the 03280 PCT application does eliminate the need for a long flame path and very tight tolerances, it does not limit access to the movable magnets to only the personnel trained to perform the zero and span adjustments. The magnets are accessible to any individual who has access to the transmitter and a screwdriver. This makes the adjustment of the zero and span setting of the transmitter subject to tampering.

According to the 03280 PCT application the adjustment of the zero and span setting of the transmitter described therein may be made resistant to tampering by removing the screws and magnets as well as the associated return springs and rubber washers from the housing. The screws, magnets, return springs and rubber washers are relatively small parts and may be easily lost or misplaced if removed from the blind holes. As described above, the rubber washers provide an environmental seal for the blind holes. The rubber washer does not provide an environmental seal for the moving parts of the zero or span adjustment mechanism during the adjustment of the zero or span settings because the washer is moved away from its sealing face when the screw is moved. Use of the adjustment mechanism may then allow environmental contaminants to accumulate in each blind hole. The accumulated environmental contaminants may cause a malfunction of the moving parts. Removal of the washers may expose the internal threads of the blind holes to conditions which may make it difficult to loosen and tighten the screws (and therefore adjust the zero and span settings of the transmitter) when the screws are reinserted into the holes.

SUMMARY OF THE INVENTION

An actuator external to a housing for magnetically actuating either a first or a second magnetically actuable switch internal to said housing. The actuator includes a single magnet mounted on a carrier. The magnet moves in response to a torque applied to the carrier. The actuator also includes means connected to said carrier for applying the torque in either a first direction or a second direction.

The application of the torque in a first direction causes the carrier to move the magnet from a first position occupied by the carrier wherein the magnet cannot actuate either of the switches when the torque is not applied to the torque applying means to a second position, which is not electrically connected to said first position, wherein said magnet is over the first switch to thereby actuate only that switch. The application of the torque in the second direction causes the carrier to move the magnet from the first position to a third position, which is not electrically connected to said first position, wherein said magnet is over the second switch to thereby actuate only that switch.

The actuator further includes means mounted on the carrier for returning the carrier to the first position from the second position when the first direction torque applied to the torque applying means is removed from the torque applying means. The returning means returns the carrier to the first position from the third position when the second direction torque applied to the torque applying means is removed from the torque applying means.

The actuator also includes an enclosure adapted for removable mounting to the housing. The enclosure contains the carrier and said means connected to said carrier for applying said torque, the enclosure including means for accessing the means connected to the carrier for applying the torque from outside of the enclosure.

An instrument that includes a housing and an actuator external to the housing. There are first and second magnetically actuable switches internal to the housing and the actuator is for magnetically actuating either the first or the second switch. The actuator includes a magnet, a carrier, torque applying means, returning means and enclosure as described above.

DESCRIPTION OF THE PREFERRED EMBODIMENTS

Figure 1:
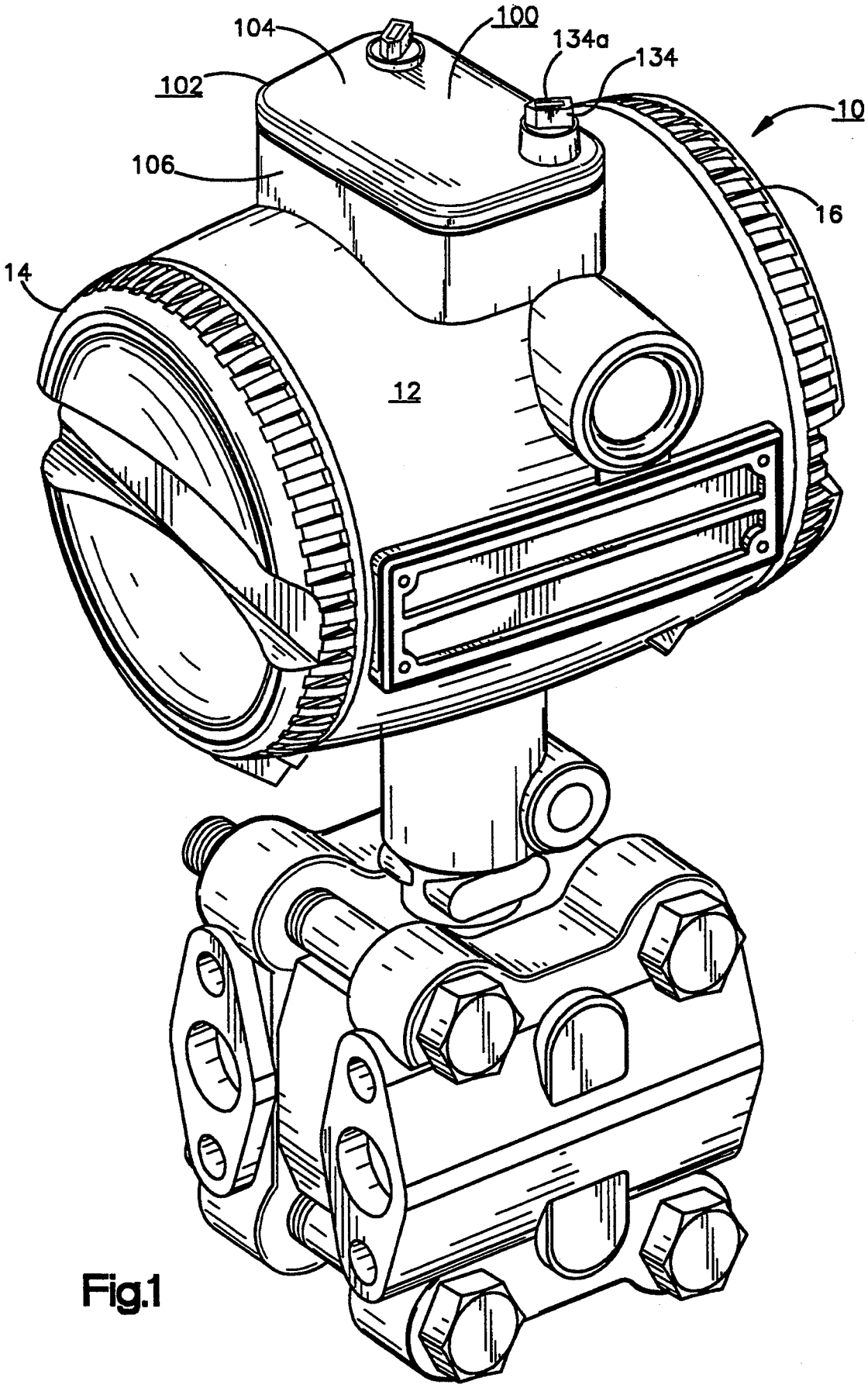
FIG. 1 shows the first embodiment for the magnetic zero and span actuator of the present invention in conjunction with a pressure transmitter.

FIG. 1 shows a pressure transmitter 10 in conjunction with the first embodiment 100 for the magnetic zero and span actuator of the present invention. Transmitter 10 has a main housing 12 which, as is shown in FIG. 1 of the 03280 PCT application, typically defines a pair of internal chambers. The transmitter's energized electronics and terminals are housed in the associated one of the two chambers. The transmitter 10 includes threaded end caps 14 and 16 which screw into mating threads (not shown) on the housing 12 to seal the chambers from the external environment and provide explosion-proof characteristics to the housing. An O-ring (not shown) may be associated with end caps 14 and 16 to thereby provide a fluid-tight seal with transmitter housing 12.

As is shown in the 03280 PCT application, a circuit board which carries some of the energized transmitter circuitry is usually positioned within one of the two interior chambers of housing 12. The energized transmitter terminals and a portion of the current loop circuit are also usually located in the same chamber wherein the circuit board is positioned.

Figure 2:
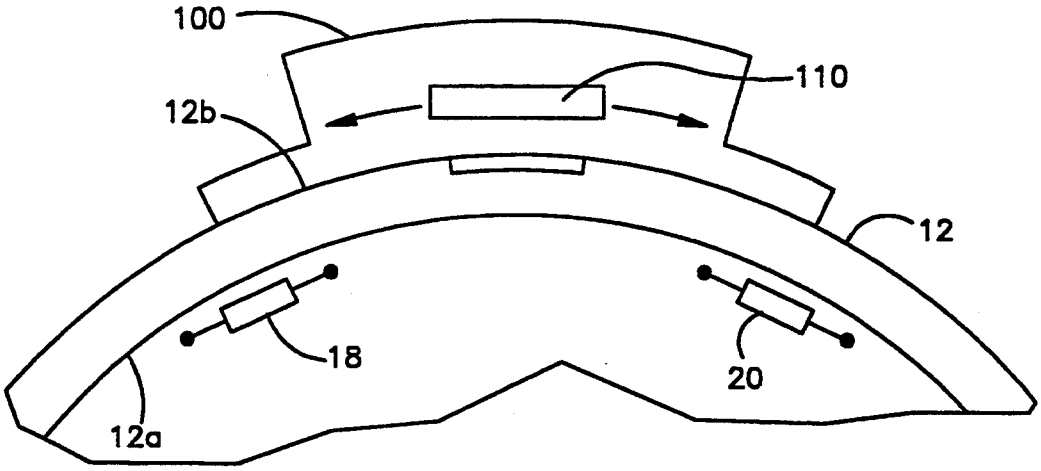
FIG. 2 shows a portion of the pressure transmitter of FIG. 1 and the location of the zero and span reed switches internal to the pressure transmitter.

Referring now to FIG. 2, there is shown the position of the magnetically actuated zero and span reed switches 8 and 20 internal to housing 12. The reed switches are usually located in the same chamber wherein the circuit board is positioned. The reed switches 18 and 20 are positioned in the chamber adjacent the inner surface 12*a* of housing 12 so as to be located just below that portion of outer surface 12*b* of housing 12 where the actuator 100 is placed when it is desired to adjust the zero and span settings of the transmitter. The reed switches may be supported in their positions by appropriate means such as the supports posts mounted to the circuit board shown and described in the 03280 PCT application or may be soldered directly to the circuit board.

Reed switches 18 and 20 are actuated by the single high coecinity magnet 110 (see FIGS. 2 and 3) included in actuator 100. The reed switches are normally open and do not close until the centerline of the single magnet in actuator 100 approaches the centerline of each of the reed switches. A detailed description of the internal construction and magnetic actuation of reed switches 18 and 20 is not needed herein as it is well known to those skilled in the art and is given in the 03280 PCT application.

Figure 3A:
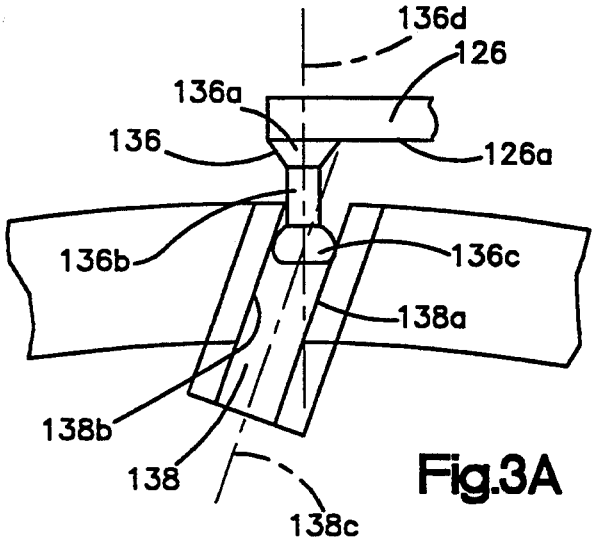
FIG. 3*a* shows an enlargement of the actuating pin of one of the actuating arms engaging the associated one of the two slots in the magnet carrier in the first embodiment of the actuator of the present invention.
Figure 3:
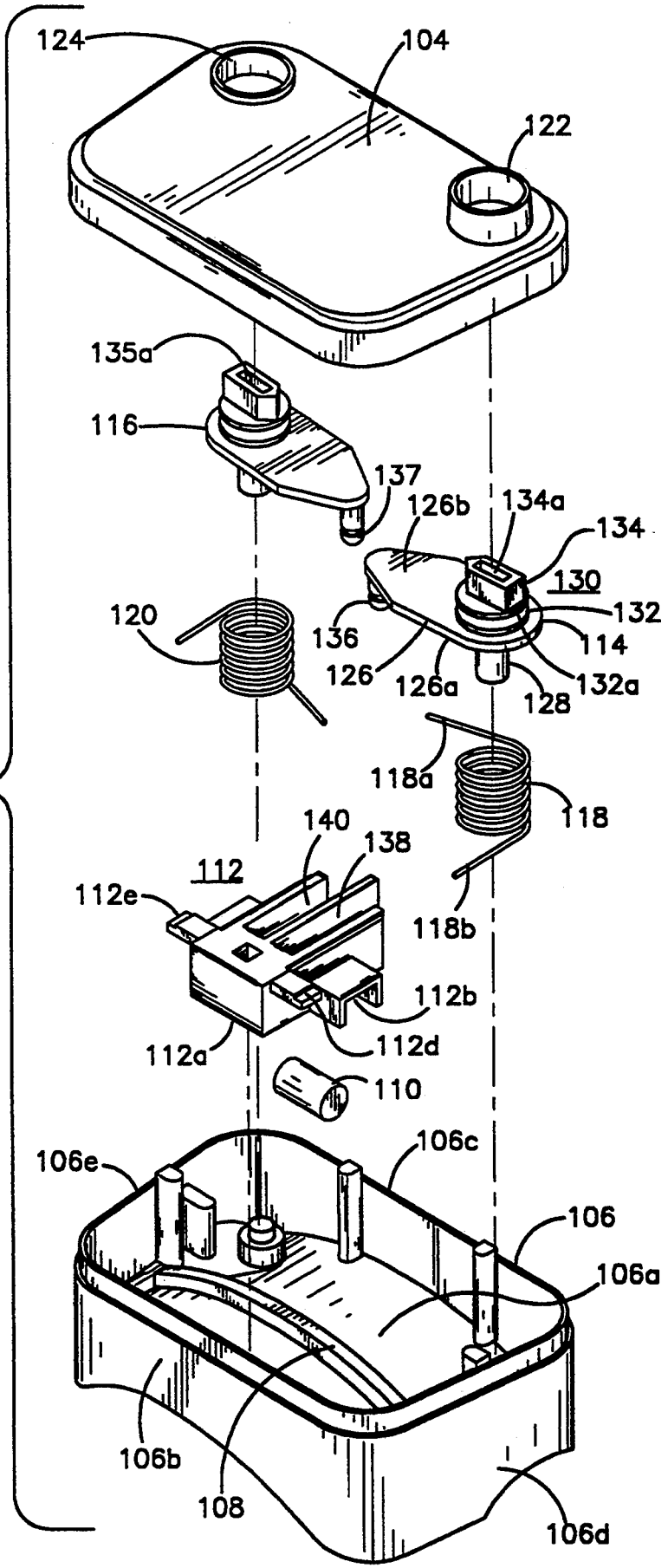
FIG. 3 shows an exploded perspective for the first embodiment of the magnetic zero and span actuator of the present invention.

Referring now to FIG. 3, there is shown an exploded perspective of the magnetic zero and span actuator 100 of the present invention. Actuator 100 includes a housing 102 (see FIG. 1) which has a top cover 104 and a bottom cover 106. The top cover 104 is removable from bottom cover 106. The inside bottom surface 106*a* of the bottom cover 106 includes a track 108 which is parallel to the front and rear walls 106*b* and 106*c* of bottom cover 106.

Actuator 100 also includes a single high coeicinity magnet 110 which fits into an opening 112*c* (shown in FIG. 5) on the underside 112*a* of magnet carrier 112. Underside 112*a* also has a slot 112*b* which is complementary in shape to track 108. Slot 112*b* allows magnet carrier 112 to slide on track 108 between right and left side walls 106*d* and 106*e* of bottom cover 106.

Actuator 100 further includes first and second identical actuating arms 114 and 116 and the associated one of first and second essentially identical return springs 118 and 120. The only difference between return springs 118 and 120 is that return spring 118 is right hand wound and return spring 120 is left hand wound. Top cover 104 includes first and second openings 122 and 124 which are associated with a respective one of actuating arms 114 and 116. Since actuating arms 114 and 116 are identical and the return springs 118 and 120 associated therewith are, except as described above, identical only actuating arm 114 and its associated return spring 118 need be described in detail.

Actuating arm 114 includes flat portion 126 which at its right end has a cylindrical post 128 extending downwardly from its bottom surface 126*a* of flat portion 126. When actuator 100 is assembled, post 128 receives return spring 118. Extending upwardly from the top surface 126*b* of flat portion 126 at the same end that post 128 extends downwardly from is post 130. Post 130 includes a first essentially cylindrical portion 132 which has a groove 132*a* for receiving an O ring (not shown). Extending upwardly from cylindrical portion 132 is an essentially rectangular portion 134 which has a slot 134*a* in its top surface for receiving the complementary shaped tip of a tool such as a screwdriver therein. When actuator 100 is assembled, the rectangular portion 134 extends through opening 122 in top cover 102 and the cylindrical portion 132 is seated therein so that the O ring mounted in groove 132*a* provides a seal for the opening 122.

At the left end of flat portion 126, an actuating pin 136 extends downwardly from surface 126*a*. Magnet carrier 112 includes first and second parallel slots 138 and 140 each associated with a respective one of the actuator pins 136 and 137 of actuator arms 114 and 116. Specifically, slot 138 is associated with the actuating pin 136 and slot 140 is associated with the downwardly extending actuating pin 137 of actuating arm 116. When actuator 100 is assembled the actuating pins 136 and 137 engage the associated one of slots 138 and 140. As will be described in more detail hereinafter, the engagement of pin 136 with slot 138 will cause magnet carrier 112 to move on track 108 towards the right side wall 106*d* when the tip of the tool is inserted in slot 134*a* and the tool is given a counterclockwise torque. Also as will be described in more detail hereinafter, the engagement of pin 137 with slot 140 will cause magnet carrier 112 to move on track 108 towards the left side wall 106*e* when the tip of the tool is inserted in slot 135*a* and the tool is given a clockwise torque.

Figure 4A:
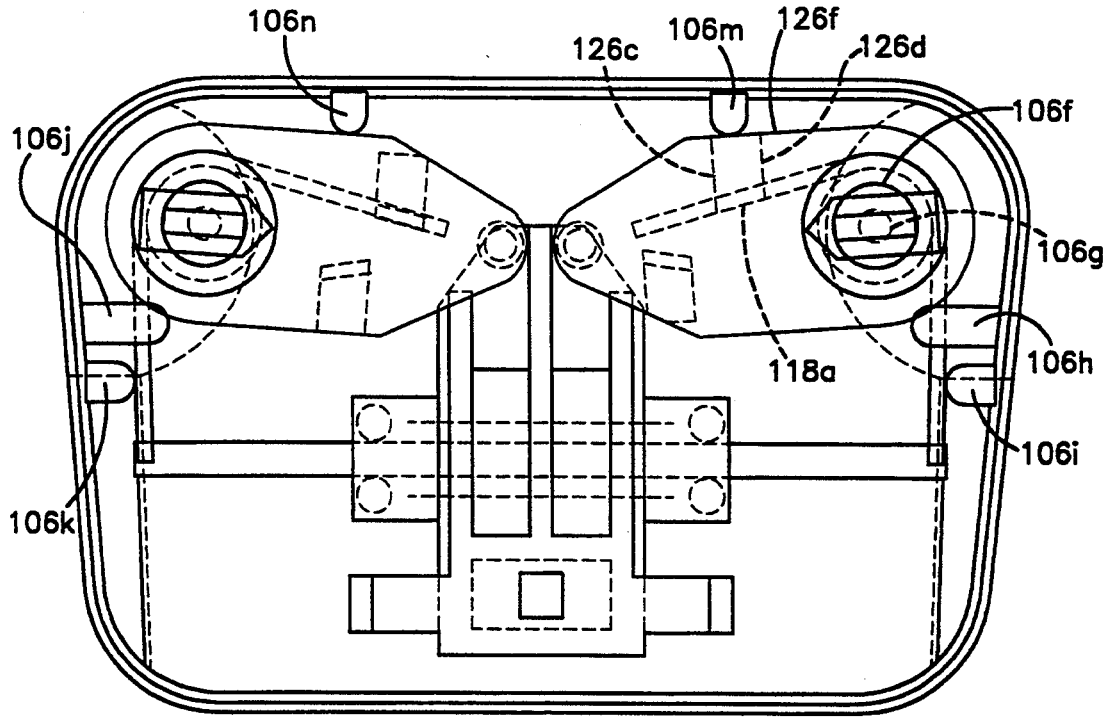
FIGS. 4*a* and 4*b* are sections taken through the first embodiment of the actuator of the present invention with the top cover of the actuator housing removed to show in FIG. 4*a* the position of the actuator arms and magnet carrier when the actuator is in its null position and in FIG. 4*b* the position of the actuator arms and the magnet carrier when one of the actuator arms is actuated to reset the span of the pressure transmitter.

Referring now to FIG. 4*a*, there is shown a section through actuator 100 with top cover 104 removed and the arms 114 and 116 in their null, i.e. unactuated positions. Slots 138 and 140 each contain a substantially double (or opposing) wall section 138*a* and 140*a* and a substantially single wall (or open) section 138*b* and 140*b* (see FIG. 3). As will be described in more detail hereinafter, this geometry of slots 138 and 140 allows the control of the position of magnet carrier 112 to be passed or alternated between actuating arms 114 and 116 while never allowing the magnet carrier to be in a state of uncontrolled motion or ambiguity. The geometry of slots 138 and 140 allows a desirable separation of the zero and span reset functions into two separate knobs and provides the actuator of the present invention as distinct advantage a compared to the prior art.

Referring now to FIG. 3*a*, there is shown an enlargement of actuating pin 136 and slot 138. Pin 136 extends downwardly from side 126*a* in a first tapered cylindrical portion 136*a*. Thereafter pin 136 continues to extend downwardly in a cylindrical portion 136*b* and terminates its downward extension in a substantially spherical knob 136*c* which engages the side walls 138*c* and 138*d* of slot 138.

As can be seen from FIG. 3*a*, the centerline 138*e* of slot 138 is at an acute angle with respect to the centerline 136*d* of actuating pin 136. The reason therefore will be described below.

Returning now to FIG. 3, it can be seen that spring 118 has first and second arms 118*a* and 118*b*. While not shown in FIG. 3, bottom 126*a* of flat portion 126 has thereon means, such as ribs 126*c* and 126*d* shown in phantom in FIG. 4*a*, to which spring arm 118*a* is clipped when spring 118 is brought into assembled relationship with post 128. The interior of bottom cover 106 includes cylindrical post 106*f* (see FIG. 4*a*) which extends upwardly from the interior bottom surface 106*a* and terminates in a smaller diameter upwardly extending cylindrical post 106*g*. As is most clearly shown in FIG. 4*a*, the interior of bottom cover 106 further includes along its right sidewall 106*d* an upwardly extending shelf 106*h* and an upwardly extending rib 106*i*. When actuator 100 is assembled, post 106*g* engages a complementary opening (not shown) in the bottom of post 128 and, as is shown in FIG. 4*a*, arm 118*b* of spring 118 rests on shelf 106*h* and against rib 106*i*.

Figure 4B:
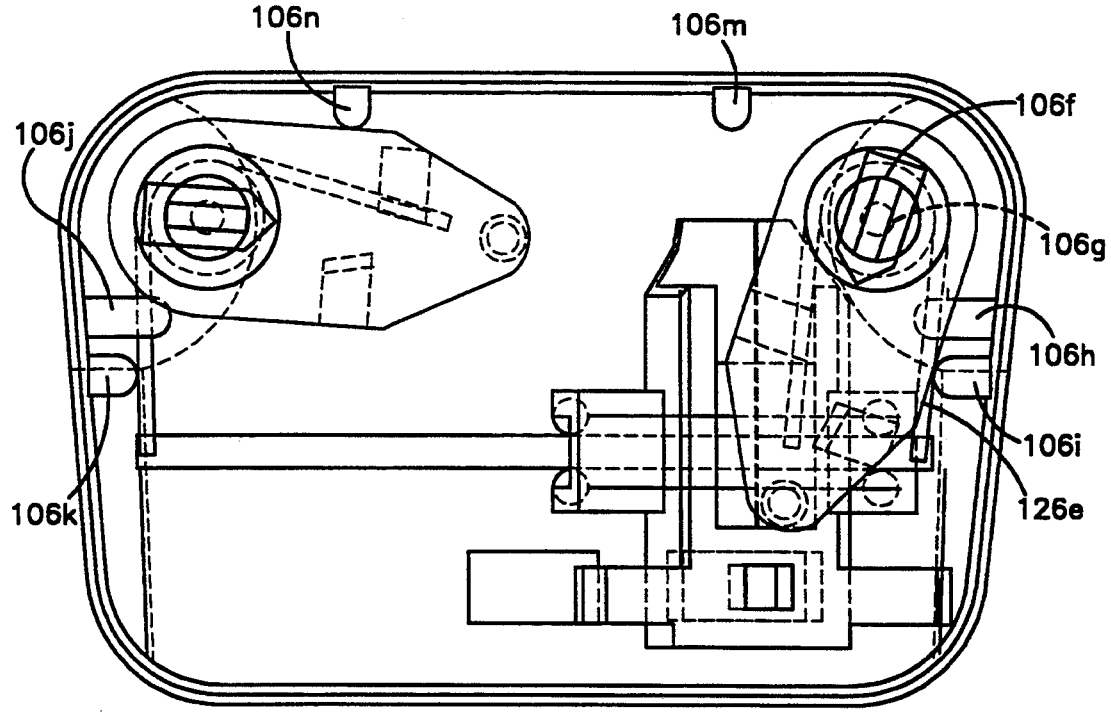

The interior of bottom cover 106 also further includes a upwardly projecting shelf and rib 106*j* and 106*k* (see FIG. 4), which are associated with left sidewall 106*e*. When actuator 100 is assembled and a counterclockwise torque is applied to actuating arm 114, the magnet carrier 112 starts to move to the right on track 108 since actuating pin 136 is in slot 138. Actuating arm 114 continues to move counterclockwise in response to the torque applied to actuating arm 114, and as is shown in FIG. 4*b*, edge 126*e* of flat portion 126 comes into contact with rib 106*i*. The contacting of edge 126*e* with rib 106*i* prevents further rightward movement of the actuating arm 114, and therefore, of magnet carrier 112 on track 108. Therefore, rib 106*i* functions as a stop when arm 114 is actuated and in a similar manner rib 106*k* functions as a stop when arm 116 is actuated. It should be appreciated that the magnet carrier has not contacted the associated side wall 106*d* or 106*e* when either arm 114 or 116 comes into contact with the associated stop 106*i* or 106*k*.

Bottom cover 106 also includes first and second arms 106*m* and 106*n* (see FIG. 4*a*) which project upwardly from interior bottom surface 106*a* adjacent the interior of rear wall 106*c*. As is shown most clearly in FIG. 4*a*, when actuator 100 is assembled and the actuating arms 114 and 116 are in their null positions, a portion of the left edge 126*f* of arm 114 rests against rear arm 106*m* and a portion of the right edge of arm 116 rests against rear arm 106*n*. Therefore, rear arms 106*m* and 106*n* function as stops for the actuating arms 114 and 116 when the actuating arms are in their null position. Arms 114 and 116 are held against stops 106*m* and 106*n* by a preload torque on springs 118 and 120 at the assembly of actuator 100, until an actuation torque is applied to either slot 134*a* or 135*a* (see FIG. 3).

Figure 5:
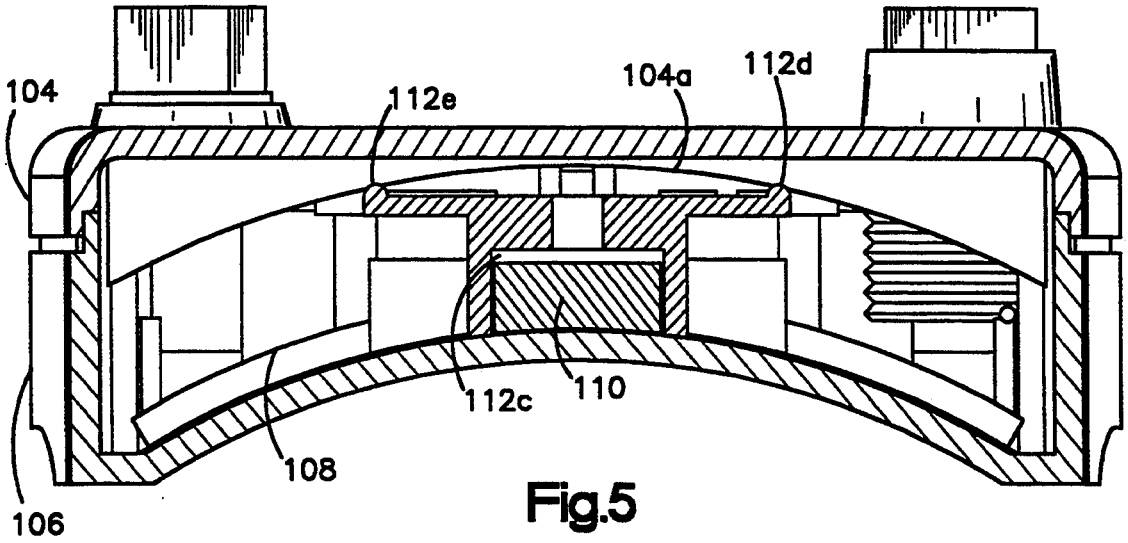
FIG. 5 is another section taken through the first embodiment of the actuator showing the high coercivity magnet in assembled relationship with the magnet carrier.

Slidable magnet carrier 112 includes first and second upwardly extending tabs 112*d* and 112*e*. As is shown in FIG. 5, when actuator 100 is assembled, tabs 112*d* and 112*e* contact track 104*a* on the inside of cover 104 to help ensure that carrier 112 follows track 108 and magnet 110 remains essentially immobile in opening 112*c* when either of arms 114 and 116 are actuated.

Opening 122 of top cover 104 has an upwardly extending sleeve 122*a* surrounding it. As is shown in FIG. 1, when actuator 100 is assembled the rectangular portion 134 of actuator arm 114 extends through opening 122. Sleeve 122*a* surrounds rectangular portion 134 over a sufficient extent of its length such that only a relatively small part of portion 134 is accessible making it difficult to grasp portion 134 by hand. Therefore, actuating arm 114 can only be actuated by inserting the tip of a screwdriver blade in slot 134*a* and applying a counterclockwise torque.

Opening 124 of top cover 104 does not have any upwardly extending sleeve surrounding it. As is shown in FIG. 1 when actuator 100 is assembled rectangular portion 135 extends through opening 124, and without any sleeve, portion 135 is accessible over essentially its entire length. Therefore, actuating arm 116 can be actuated not only by inserting the tip of a screwdriver blade into slot 135*a* but also by grasping rectangular portion 135 and applying a clockwise torque by hand.

In actuator 100, actuating arm 114 is used to reset the span of transmitter 10 while actuating arm 116 is used to reset the zero of the transmitter. Therefore, sleeve 122*a* ensures that the span of the transmitter can be reset only by using a tool while the lack of an equivalent sleeve surrounding opening 124 allows the zero of the transmitter to be reset either by using a tool to apply the necessary torque or applying that torque by hand.

The operation of actuator 100 will now be described in connection with FIGS. 4*a* and 4*b*. Referring first to FIG. 4*a* the actuator arms 114 and 116 are shown in their null position. As was previously described, in the null position arms 114 and 116 are held against stops 106*m* and 106*n* by a preload torque on springs 118 and 120 at the assembly of actuator 100, until an actuation torque is applied to either slot 134*a* or 135*a*. Actuating pins 136 and 137 are stationed in the single wall sections 138*b* and 140*b* of slots 138 and 140 when the actuator arms are in the null position.

The application of a counterclockwise torque to arm 114 causes the arm and therefore pin 136 to move in the counterclockwise direction from the null position. During this motion of arm 114, arm 116 is held in the null position by the preload torque of spring 120. Continued counterclockwise movement of the pin brings the pin 136 into contact with side wall 138*c* of slot 138. At that point the continued application of counterclockwise torque to actuating arm 114 causes the magnet carrier to begin to move to the right on track 108. Since the opening of the single wall section 140*b* is greater than the diameter of pin 137, the movement of the magnet carrier to the right is unimpeded by pin 137.

In response to continued counterclockwise movement of pin 136, magnet carrier 112 continues to move to the right until edge 126*e* comes into contact with rib 106*i*. As is shown in FIG. 4*b*, further movement to the right of magnet carrier 112 is impeded by rib 106*i*. The centerline of magnet 110 is now essentially over the centerline of span reed switch 18. Reed switch 18 closes and the closing of the reed switch sets the span of transmitter 10. After the span of the transmitter is set, the torque that the preload torque on spring 118 causes was applied to actuating arm 114 can be removed and the actuating arm to move clockwise and the magnet carrier to move to the left. When the edge 126*f* comes into contact with stop 106*m* the magnetic carrier and the actuating arm have returned to the null position.

The zero of the transmitter can be set in a manner similar to that described above for setting the span of the transmitter. To set the zero, a clockwise torque is applied to actuating arm 116 when actuating arms 114 and 116 are in the null position. In response thereto, arm 116 and pin 137 moves in the clockwise direction until the pin comes into contact with the left wall of slot 140. Continued clockwise movement of pin 137 causes the magnet carrier 112 to move to the left on track 108. Since the opening of the single wall section 138*b* is greater than the diameter of pin 136, the movement of the magnet carrier to the left is unimpeded by pin 136.

The magnet carrier continues to move to the left in response to a clockwise torque on actuating arm 116 until the left edge of the flat portion of the actuating arm comes into contact with rib 106*k*. The centerline of magnet 110 is then essentially over the centerline of zero reed switch 20. Reed switch 20 closes and the closing of the reed switch sets the zero of transmitter 10. After the zero of the transmitter is set, the torque that was applied to actuating arm 116 can be removed and the preload torque on spring 120 causes the actuating arm to move counterclockwise and the magnet carrier to move to the right. When the right edge of the flat portion of actuating arm 116 comes into contact with stop 106*n* the magnetic carrier and the actuating arm have returned to the null position.

A detailed description of how the zero or the span of a transmitter is set when the zero or span reed switch closes is not needed herein as it is well known to those skilled in the art. Such a description is given in the 03280 PCT application.

Referring once again to FIGS. 1 and 3, it is seen that the actuator 100 sits on the exterior of transmitter housing 12 and is removable therefrom. The inside bottom surface 106*a* of bottom 106 is complementary in shape to the shape of that portion of the transmitter housing upon which the actuator sits. When it is desired to set either the zero and/or the span of transmitter 10, the personnel trained to perform those adjustments seat actuator 100 in place on the exterior of the transmitter. After the zero and/or span have been set, the actuator 100 is removed as a single unit from the transmitter exterior thereby ensuring that the zero and span settings of the transmitter cannot be tampered with. It is not necessary to remove either the magnet 110 or the actuating arms 114 and 116 from the actuator in order to ensure that the transmitter's zero and span settings will not be tampered with. Additionally and in contrast to the prior art, the removal of actuator 100 does not leave any screw threads on the transmitter housing which may be exposed to undesirable conditions.

Figure 6:
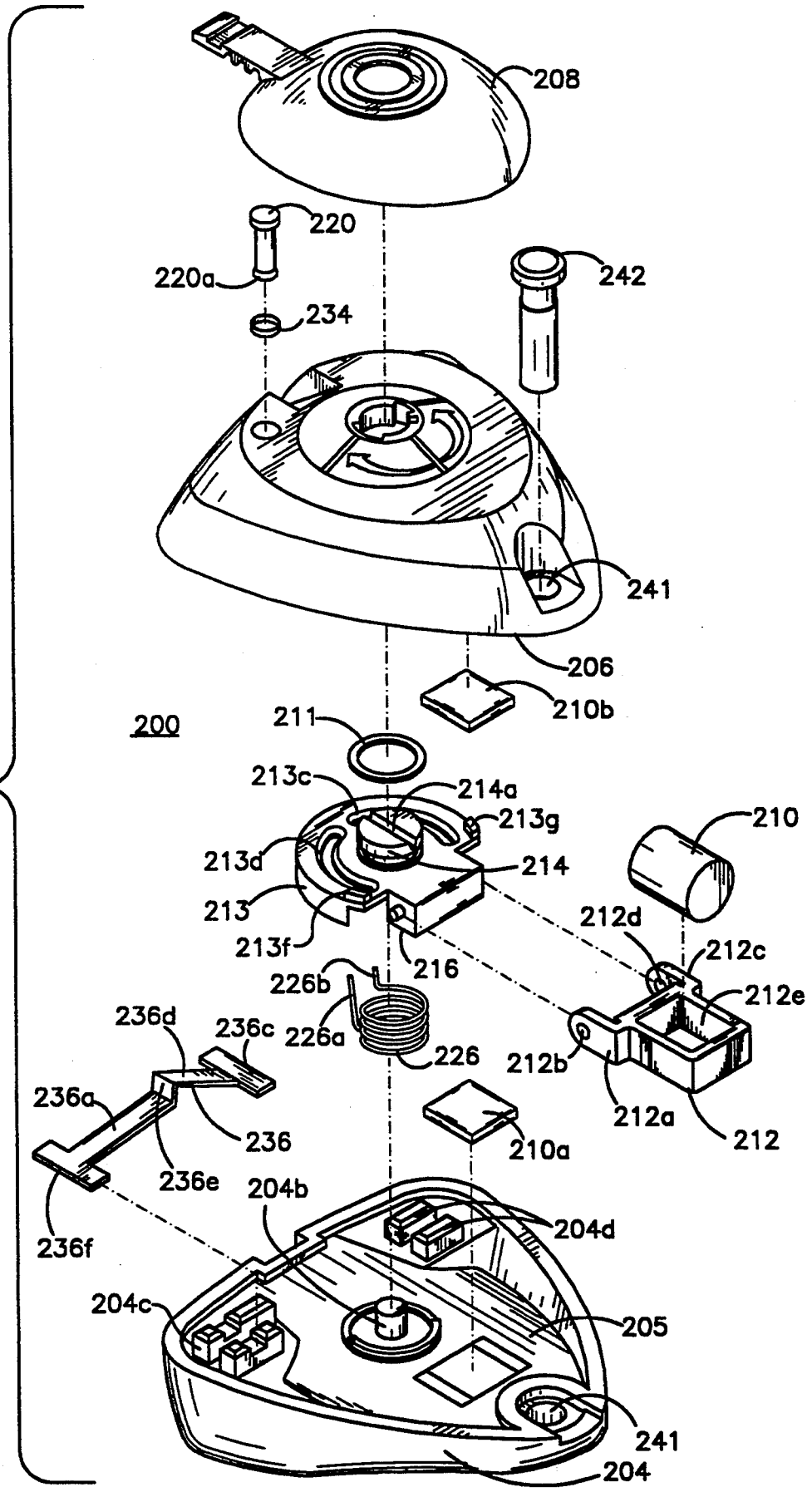
FIG. 6 shows an exploded perspective for a second embodiment of the magnetic zero and span actuator of the present invention.

Referring now to FIG. 6, there is shown an exploded perspective for a second embodiment 200 for the actuator of the present invention. The actuator 200 has a housing 202 with a bottom cover 204 and a top cover 206 which is removably mounted on bottom cover 204. Top cover 206 includes a hinged dust cap 208 which is opened when it is desired to adjust the zero and/or span reed switches 18 and 20.

Figure 9:
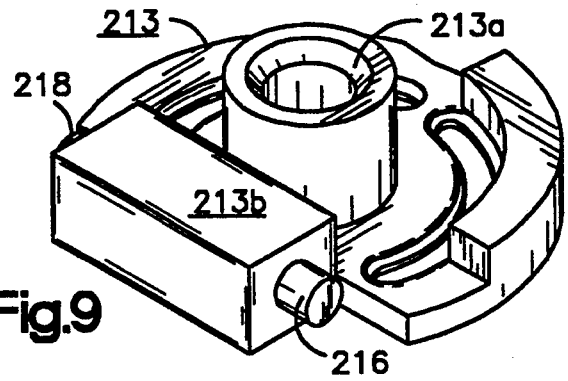
FIG. 9 shows the bottom of the hub.

Actuator 200 also includes a single high coercinity magnet 210 which is mounted in an opening 212*e* of a magnet carrier 212. Actuator 200 also includes a hub 213 which has included as a part thereof a control knob 214. The control knob and therefore the hub 213 is rotatable either in the clockwise or counterclockwise directions. Magnet carrier 212 has a first rearwardly projecting arm 212*a* having an opening 212*b* therein and a second rearwardly projecting arm 212*c* having an opening 212*d* therein. Arm 212*c* is parallel to arm 212*a*. Hub 213 has drive pins 216, 218 (see FIG. 9) and the openings 212*b* and 212*d* of the magnet carrier are attached to the pins 216, 218 in a manner such that carrier 212 can be rotated only about the drive pins when control knob 214 is rotated in the clockwise and counterclockwise directions.

Figure 12:
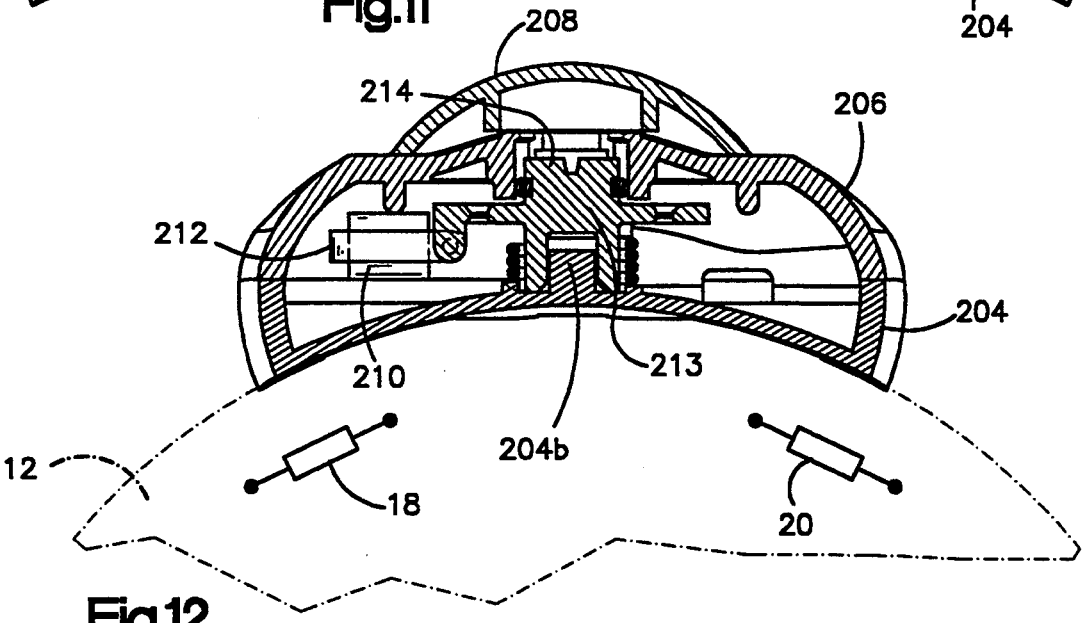
FIG. 12 shows a simplified section through the second embodiment for the actuator with the high coercivity magnet and the magnet carrier rotated in the counterclockwise position so as to reset the zero of the transmitter.

Control knob 214 includes slot 214*a* to receive the tip of a screwdriver blade therein to thereby apply either a clockwise or counterclockwise torque to the control knob. As will be described in more detail below when actuator 200 is assembled a counterclockwise torque applied to the control knob 214 will cause the hub 213 and therefore the magnet carrier 212 to rotate 90° in that direction so as to be brought essentially over the centerline of zero reed switch 18, as is shown in the simplified section of FIG. 12, to thereby close that reed switch and reset the zero of the transmitter. Also as will be described in more detail below a clockwise torque applied to control knob 214 will, provided span safety lock pushbutton 220 is depressed to release a lock spring 236, cause the hub 213 and therefore the magnet carrier 212 to rotate 90° in that direction so as to be brought essentially over the centerline of span reed switch 20 to thereby close that reed switch and reset the span of the transmitter.

Actuator 200 further includes an O-ring 211 which seals against an inside diameter 206*a* (see FIG. 8) in the roof 207 of top cover 206 to thereby provide a seal against water and contaminants entering the actuator 200. The hub 213 has a blind hole 213*a* (see FIG. 9) on axis in its bottom 213*b* which fits over a raised stud 204*b* in the floor 205 of bottom cover 204. Stud 204*b* establishes a rotation axis for the hub. The floor 205 of bottom cover 204 sustains axial thrust placed on the hub 213 by the screwdriver inserted in slot 214*a*.

Actuator 200 also further includes a return spring 226. The spring 226 provides the torque to return the hub 213 and therefore control knob 214 to the null position after the knob is rotated either in the clockwise or counterclockwise directions to adjust the reed switches. The spring 226 is placed under a rotational preload as it is brought into assembled relationship with hub 213. Hub 213 includes slots 213*c* and 213*d*.

Figure 7:
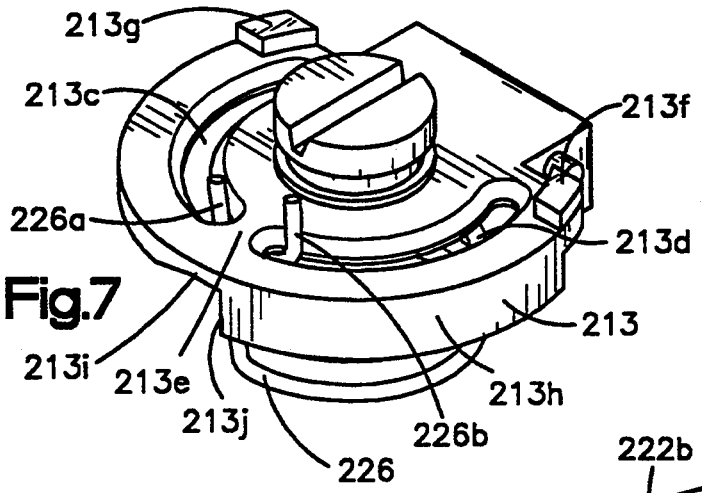
FIG. 7 shows the subassembly of the hub and the return spring used in the second embodiment for the actuator.
Figure 8:
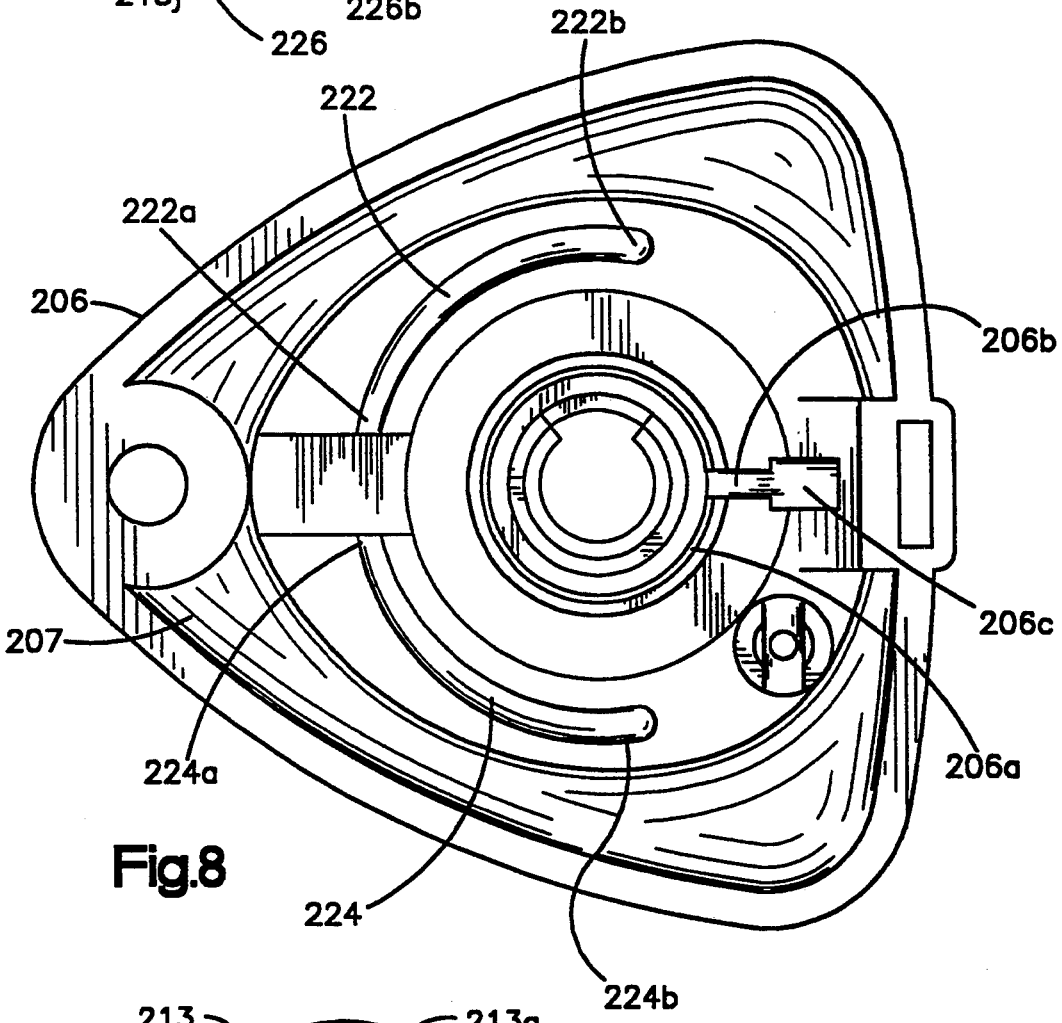
FIG. 8 shows the roof of the top cover of the second embodiment for the actuator.

Referring to FIG. 7, there is shown the spring 226 and hub 213 in assembled relationship. As can be seen from a comparison of FIGS. 6 and 7, when spring 226 is brought into assembled relationship with hub 213, the free end 226*a* of the spring is placed in slot 213*c* and the free end 226*b* of the spring is placed in slot 213*d* to maintain the rotational preload. The portion 213*e* of hub 213 between slots 213*c* and 213*d* holds the free ends of the spring at a gap when the control knob 214 and therefore the hub 213 and the magnet carrier 212 are in the null, that is, unactuated, position. As is shown in FIG. 8, the roof 207 of top cover 206 includes a rib 206*b*. When the actuator 200 is assembled and in the null position the free ends 226*a* and 226*b* of spring 226 rest against an associated edge of the rib 206*b*.

As is shown in FIG. 6, hub 213 also includes stops 213*f* and 213*g*. The roof 207 of top cover 206 (see FIG.

8) includes another rib 206c. When the hub is rotated 90° in the counterclockwise direction stop 213f comes into contact with one edge of rib 206c. When the hub 213 is rotated 90° in the clockwise direction stop 213g comes into contact with the other edge of rib 206c. It should be appreciated that it is stops 213f and 213g of hub 213 and not the magnet carrier 212 that comes into contact with the associated edge of rib 206c to limit the travel of the magnet carrier to not more than 90° in the clockwise and counterclockwise directions. This interaction between stops 213f and 213g of hub 213 and rib 206c prevents stress on magnet carrier 212 when the carrier is rotated 90° in either direction from the null position and thereby reduces the likelihood that the magnet carrier will fail.

As is shown in FIG. 7, when the spring 226 and the hub 213 are in assembled relationship free ends 226a and 226b of the spring project upwardly through slots 213c and 213d, respectively. When the actuator 200 is assembled the free ends of the spring come into contact with the edges of rib 206b. If control knob 214 is rotated in the counterclockwise direction, free end 226a is kept from moving by its associated edge of rib 206b and free end 226b can move in 213d as it is not kept from moving by its associated edge of rib 206b. This action spreads the spring in one direction and provides the torque to return the spring to the null position. If control knob 214 is rotated in the clockwise direction, free end 226b is kept from moving by its associated edge of rib 206b and free end 226a can move in 213c as it is not kept from moving by its associated edge of rib 206b. This action spreads the spring in the opposite direction and provides the torque to return the spring to the null position.

It is the spring 226, portion 213e of hub 213 and rib 206b which allow the control knob 214 and therefore the hub 213 and the magnet carrier 212 to rotate 90 degrees in either direction from the null position and have a spring return to an "off" position that is defined by a deadband region of no spring force on the control knob 214. The deadband region has a width which is no greater than the width of portion 213e.

When the control knob 214 is in the null position the magnet carrier 212 and therefore single high coercinity magnet 210 is midway between reed switches 18 and 20. As is shown in FIG. 6, actuator 200 includes magnetic shunts 210a and 210b mounted in appropriate receptacles therefor in the floor 205 and the roof 207, respectively, to provide a short circuit magnetic path for the magnetic flux from magnet 210. When the control knob 214 is in the null position the magnet 210 is positioned physically away from the reed switches and between shunts 210a and 210b. Therefore, shunts 210a and 210b together with a relative separation between the reed switches and the magnet, prevent magnet 210 from turning on the reed switches 18 and 20 when the magnet carrier is in the null position.

Referring now to FIG. 8, there is shown first and second curved guide tracks 222 and 224 in the roof 207 of top cover 206. Guide track 222 is associated with reed switch 18 and has a first end 222a adjacent the null position of magnet carrier 212 and a second end 222b adjacent the position of magnet carrier 212 when it is rotated 90° in the counterclockwise direction. Guide track 224 is associated with reed switch 20 and has a first end 224a adjacent the null position of magnet carrier 212 and a second end 224b adjacent the position of magnet carrier 212 when it is rotated 90° in the clockwise direction.

As can be seen in FIG. 8, guide track 222 increases in thickness from end 222a to 222b and guide track 224 increases in thickness from end 224a to 224b. When control knob 214 is rotated 90° in the counterclockwise direction the magnet carrier 212 follows the curve of the floor 205 (see FIG. 6) of bottom cover 204 and the curve of guide track 222 to bring the centerline of magnet 210 essentially over the centerline of zero reed switch 18 (see the simplified section of the actuator 200 shown in FIG. 12) to thereby close that reed switch and reset the zero of the transmitter. The increasing thickness of track 222 from end 222a to end 222b ensures that magnet 210 is close to reed switch 18 when the magnet carrier has rotated 90° counterclockwise. When control knob 214 is rotated 90° in the clockwise direction, provided span safety lock pushbutton 220 is depressed to release lock spring 236, the magnet carrier follows the curve of the floor 205 and guide track 224 to bring the centerline of magnet 210 essentially over the centerline of span reed switch 20 to thereby close that reed switch and reset the span of the transmitter. The increasing thickness of track 224 from end 224a to end 224b ensures that magnet 210 is close to reed switch 20 when the magnet carrier has rotated 90° clockwise.

It should be appreciated that floor 205 and guide tracks 222 and 224 form first and second curved paths to direct the rotational motion of the magnet carrier 212 as the control knob 214 is rotated in the clockwise or counterclockwise directions. These curved paths allow the magnet 210 to achieve both a close radial distance and parallel orientation to the reed switches 18 and 20. The close radial distance and the parallel orientation achieved by the magnet 210 of actuator 200 substantially helps the actuation of the reed switches by the magnet.

Referring once again to FIG. 6, it can be seen that the span safety switch pushbutton 220 includes an O-ring seal 234 and has a self retaining tip 220a. Lock spring 236 includes a first straight portion 236a, first and second ends 236b and 236c, second straight portion 236d and a transition 236e between portions 236a and 236d. First straight portion 236a has a slight upward slope from end 236b toward end 236c. Second straight portion 236d slopes downwardly toward end 236c from essentially upwardly extending transition portion 236e.

Figure 11:
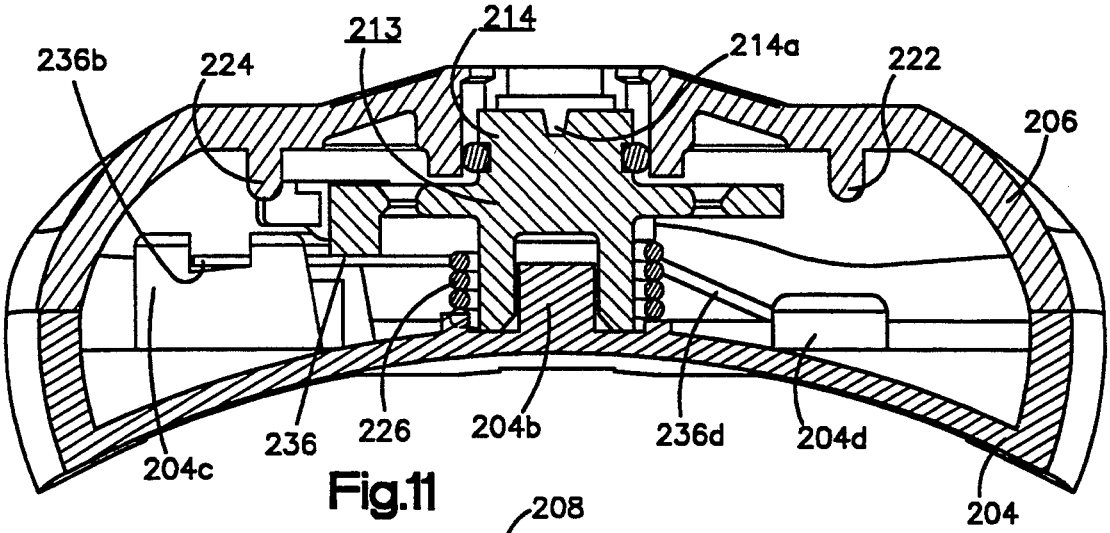
FIG. 11 shows a section through the assembled second embodiment for the actuator with the hub in the null position.

When actuator 200 is fully assembled the lower end 220a of pushbutton 220 is in contact with first straight portion 236a of lock spring 236 near one end 236b of the lock spring. As is shown in FIG. 11, when the actuator is assembled, end 236b is seated in an upwardly projecting complementary shaped receptacle 204c in floor 205 and end 236c rests on the top of upward projecting ribs 204d in the floor 205. It should be appreciated that the lock spring does not rotate when the hub is rotated.

Referring once again to FIG. 7, it is seen that the side of the hub 213 has a relatively thick portion 213h which extends from the rightmost edge of stop 213f to about the rightmost edge of portion 213e. At that point the side undergoes an abrupt reduction in its thickness at edge 213j to a relatively thin portion 213i which extends from about the rightmost edge of portion 213e to the leftmost edge of stop 213g.

When actuator 200 is assembled and is in the null position the upward transition 236e of lock spring 236 is just to the left of edge 213j. This location of the upward transition of the lock spring relative to edge 213j in the null position, except as described below, prevents rotation of the hub in the clockwise direction unless the pushbutton 220 (see FIG. 6) is depressed to thereby push down the lock spring. While not shown in FIG. 6, floor 205 includes an upwardly circular post which is positioned to be just below the point on lock spring 236*a* which is contacted by end 220*a* of the pushbutton. The post limits the downward motion of the lock spring when it is contacted by end 220*a*.

Figure 10:
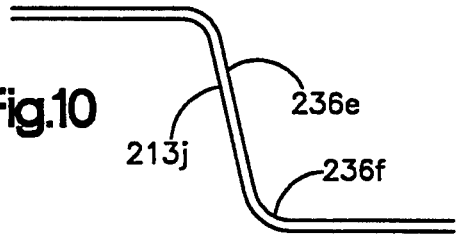
FIG. 10 shows an enlargement of the lock spring and hub interface when the second embodiment for the actuator is assembled and is in the null position.

Referring now to FIG. 10, there is shown an enlargement of the interface between lock spring edge 236*e* and transition 213*j* of the hub edge. Lock spring 236 is designed to provide a predetermined breakaway torque that will allow edge 236*e* to slide by transition 213*j* in the hub edge and thereby allow rotation of the hub in the clockwise direction if an individual should try to rotate the hub in that direction without first depressing pushbutton 220. The predetermined breakaway torque is selected to avoid any physical damage to the hub and the lock spring.

In designing the lock spring it was found that the slight chamfer 236*f* in the transition shown in FIG. 10 helped to maintain the contact area between edge 236*e* and the transition 213*j* even after repeated torquing of the hub in the clockwise direction without depressing the pushbutton 220. Hub 213 may be fabricated from series 300 stainless steel, lock spring 236 from 17-7 PH stainless steel heat treated to RH950 per ASTM 693 and the chamfer may be in the order of 25° on each edge.

In addition to the function described above, lock spring 236 also affords some additional detent action to the control knob 214 when it is in the null position. This detent action in combination with O-ring 211, and shunts 210*a*, 210*b* provides resistance to the control knob to help avoid undesirable vibration induced motion which might otherwise accidentally actuate the reed switches.

Figure 13:
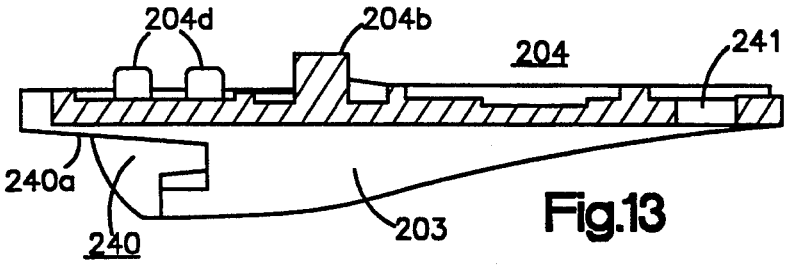
FIG. 13 shows the outside of the bottom cover of the housing for the second embodiment of the actuator.

Referring now to FIGS. 6 and 13, the manner in which the actuator 200 is mounted to the transmitter main housing 12 when it is desired to reset the zero and/or span reed switches will now be described. The outside 203 of the bottom cover 204 includes first and second identical means 240 for mounting the actuator 200 to the transmitter housing. Only one of those means is shown in FIG. 13. In addition, and as is shown in FIG. 6, the actuator housing 202 includes a single hole 241 to receive screw 242.

The transmitter housing 12 includes first and second actuator receiving means (not shown) which are complementary in shape to the means 240. The actuator 200 is mounted on housing 12 by first interfitting each of the two actuator mounting means 240 with the associated one of the two complementary actuator receiving means on the transmitter and then tightening screw 242. When the actuator is mounted on the transmitter housing, the portion 240*a* of the actuator mounting means 240 shown in FIG. 13 rests on top of the associated actuator receiving means to thereby provide support for the actuator. As can be seen in FIG. 6, the actuator housing 202 has sloped and low profile outside surfaces which avoid the placement of side forces on the actuator in the event someone climbing the installed equipment uses the transmitter 10 as a step.

It is to be understood that the description of the preferred embodiments are intended to be only illustrative, rather than exhaustive, of the present invention. Those of ordinary skill will be able to make certain additions, deletions, and/or modifications to those embodiments of the disclosed subject matter without departing from the spirit of the invention or its scope, as defined by the appended claims.

What is claimed is:

1. An actuator external to a housing for magnetically actuating either a first or a second magnetically actuable switch internal to said housing; said actuator comprising:

a. a single magnet mounted on a carrier which moves in response to a torque applied to said carrier;

b. means connected to said carrier for applying said torque in either a first direction or a second direction to cause said carrier to move said magnet from a first position occupied by said carrier wherein said magnet cannot actuate either of said switches when said torque is not applied to said torque applying means to either a second position, which is not electrically connected to said first position, wherein said magnet is over said first switch to thereby actuate only said first switch or a third position, which is not electrically connected to said first position, wherein said magnet is over said second switch to thereby actuate only said second switch, said carrier moving from said first position to said second position in response to said first direction torque applied to said torque applying means, said carrier moving from said first position to said third position in response to said second direction torque applied to said torque applying means;

c. means mounted on said carrier for returning said carrier to said first position from said second position when said first direction torque applied to said torque applying means is removed from said torque applying means and for returning said carrier to said first position from said third position when said second direction torque applied to said torque applying means is removed from said torque applying means; and d. an enclosure adapted for removable mounting to said housing, said enclosure containing said carrier and said means connected to said carrier for applying said torque, said enclosure including means for accessing said means connected to said carrier for applying said torque from outside of said enclosure.

2. The actuator of claim 1 wherein said magnet moves from said first position to said second position when a clockwise torque is applied to said torque applying means and said magnet moves from said first position to said third position when a counterclockwise torque is applied to said torque applying means.

3. The actuator of claim 1 wherein said magnet moves from said first position to said second position when a clockwise torque is applied to said torques applying means and said magnet moves from said first position to said third position when a counterclockwise torque is applied to said torque applying means and said magnet returning means returns said magnet from said second position to said first position by applying a counterclockwise torque to said magnet when said clockwise torque applied to said torque applying means is removed and said magnet returning means returns said magnet from said third position to said first position by applying a clockwise torque to said magnet when said counterclockwise torque applied to said torque applying means is removed.

4. The actuator of claim 1 wherein removal from said torque applying means of said first direction torque applied to said torque applying means is not caused by actuation of said first switch and removal from said torque applying means of said second direction torque applied to said torque applying means is not caused by actuation of said second switch.

5. An instrument comprising:

a. a housing having first and second magnetically actuable switches internal to said housing;

b. an actuator external to said housing for magnetically actuating either said first or said second magnetically actuable switch;

said actuator comprising:

i. a single magnet mounted on a carrier which moves in response to a torque applied to said carrier;

ii. means connected to said carrier for applying said torque in either a first direction or a second direction to cause said carrier to move said magnet from a first position occupied by said carrier wherein said magnet cannot actuate either of said switches when said torque is not applied to said torque applying means to either a second position, which is not electrically connected to said first position, wherein said magnet is over said first switch to thereby actuate only said first switch or a third position, which is not electrically connected to said first position, wherein said magnet is over said second switch to thereby actuate only said second switch, said carrier moving from said first position to said second position in response to said first direction torque applied to said torque applying means, said carrier moving from said first position to said third position in response to said second direction torque applied to said torque applying means;

iii. means mounted on said carrier for returning said carrier to said first position from said second position when said first direction torque applied to said torque applying means is removed from said torque applying means and for returning said carrier to said first position from said third position when said second direction torque applied to said torque applying means is removed from said torque applying means; and c. an enclosure removably mounted on said instrument housing, said enclosure containing said carrier and said means connected to said carrier for applying said torque, said enclosure including means for accessing said means connected to said carrier for applying said torque from outside of said enclosure.

6. The instrument of claim 5 wherein removal from said torque applying means of said first direction torque applied to said torque applying means is not caused by actuation of said first switch and removal from said torque applying means of said second direction torque applied to said torque applying means is not caused by actuation of said second switch.

7. The actuator of claim 1 wherein said enclosure also contains said means mounted on said carrier for returning said carrier.

8. The actuator of claim 4 wherein said enclosure also contains said means mounted on said carrier for returning said carrier.

9. The actuator of claim 1 wherein said enclosure has a top cover and a bottom cover, said top cover removably mounted on said bottom cover and said top cover including said means for accessing said means connected to said carrier for applying said torque from outside of said enclosure.

10. The actuator of claim 9 wherein said top cover has an outside surface and an inside surface and said inside surface has means for guiding said magnet so that said magnet is positioned over said first switch when said first direction torque is applied to said torque applying means and is positioned over said second switch when said second direction torque is applied to said torque applying means.

11. The actuator of claim 10 wherein said guiding means is a first track projecting downwardly from said inside surface for guiding said magnet into a position over said first switch when said first direction torque is applied to said torque applying means and a second track projecting downwardly from said inside surface for guiding said magnet into a position over said second switch when said second direction torque is applied to said torque applying means.

12. The actuator of claim 10 wherein said guiding means projects downwardly from said inside surface and extends from said first position to said second position and from said first position to said third position and has an increasing thickness from said first position to said second position to thereby ensure said magnet is positioned over said first switch and increasing thickness from said first position to said third position to thereby ensure that said magnet is positioned over said second switch.

13. The actuator of claim 11 wherein said first track extends from said first position to said second position and has an increasing thickness from said first position to said second position to thereby ensure that said magnet is positioned over said first switch and said second track extends from said first position to said third position and has an increasing thickness from said first position to said third position to thereby ensure that said magnet is positioned over said second switch.

14. The instrument of claim 6 wherein said enclosure also contains said means mounted on said carrier for returning said carrier.

15. The instrument of claim 6 wherein said enclosure also contains said means mounted on said carrier for returning said carrier.

16. The instrument of claim 5 wherein said enclosure has a top cover and a bottom cover, said top cover removably mounted on said bottom cover and said top cover including said means for accessing said means connected to said carrier for applying said torque from outside of said enclosure.

17. The instrument of claim 16 wherein said enclosure top cover has an outside surface and an inside surface and said inside surface has means for guiding said magnet so that said magnet is positioned over said first switch when said first direction torque is applied to said torque applying means and is positioned over said second switch when said second direction torque is applied to said torque applying means.

18. The instrument of claim 17 wherein said enclosure inside surface guiding means is a first track projecting downwardly from said inside surface for guiding said magnet into a position over said first switch when said first direction torque is applied to said torque applying means and a second track projecting downwardly from said inside surface for guiding said magnet into a position over said second switch when said second direction torque is applied to said torque applying means.

19. The instrument of claim 17 wherein said enclosure inside surface guiding means projects downwardly from said inside surface and extends from said first position to said second position and from said first position to said third position and has an increasing thickness from said first position to said second position to thereby ensure that said magnet is positioned over said first switch and has an increasing thickness from said first position to said third position to thereby ensure that said magnet is positioned over said second switch.

20. The instrument of claim 18 wherein said enclosure top cover inside surface first track extends from said first position to said second position and has an increasing thickness from said first position to said second position to thereby ensure that said magnet is positioned over said first switch and said enclosure top cover inside surface second track extends from said first position to said third position and has an increasing thickness from said first position to said third position to thereby ensure that said magnet is positioned over said second switch.

* * * * *